US007791570B2

(12) United States Patent
Sempel

(10) Patent No.: US 7,791,570 B2
(45) Date of Patent: Sep. 7, 2010

(54) ELECTRICAL CIRCUIT ARRANGEMENT FOR A DISPLAY DEVICE

(75) Inventor: Adrianus Sempel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1030 days.

(21) Appl. No.: 10/598,765

(22) PCT Filed: Mar. 2, 2005

(86) PCT No.: PCT/IB2005/050769

§ 371 (c)(1),
(2), (4) Date: Sep. 11, 2006

(87) PCT Pub. No.: WO2005/091269

PCT Pub. Date: Sep. 29, 2005

(65) Prior Publication Data

US 2007/0182684 A1 Aug. 9, 2007

(30) Foreign Application Priority Data

Mar. 12, 2004 (EP) ..... 04101031

(51) Int. Cl.
*G09G 3/32* (2006.01)

(52) U.S. Cl. ..... 345/82; 345/83

(58) Field of Classification Search ..... 345/51, 345/76–78, 80, 82, 83, 92, 98, 204, 207, 345/690; 382/162, 285; 348/246, 218.1, 348/42, 49; 257/431
See application file for complete search history.

(56) References Cited

U.S. PATENT DOCUMENTS 4,118,698 A * 10/1978 Becker ..... 341/120
6,278,423 B1 * 8/2001 Wald et al. ..... 345/76
6,355,965 B1 * 3/2002 He et al. ..... 257/431
6,414,661 B1 * 7/2002 Shen et al. ..... 345/82
6,421,033 B1 7/2002 Williams et al.
7,088,311 B2 * 8/2006 Kasai ..... 345/51
7,138,992 B2 * 11/2006 Nakamura ..... 345/207
7,466,596 B2 * 12/2008 Ausserlechner et al. 365/185.23
2001/0052606 A1 12/2001 Sempel et al.
2002/0044110 A1 * 4/2002 Prache ..... 345/82
2004/0239782 A1 * 12/2004 Equitz et al. ..... 348/246

(Continued)

FOREIGN PATENT DOCUMENTS

EP 1288905 A2 3/2003

(Continued)

OTHER PUBLICATIONS

ISR: PCT/IB05/050769, mailing date Jun. 3, 2005 and completion date May 25, 2005.

(Continued)

*Primary Examiner*—Prabodh Dharia

(57) ABSTRACT

Disclosed is a method for addressing a display pixel and an electrical circuit arrangement for the display device. In some embodiments, the electrical circuit arrangement includes an input terminal for receiving a first signal; a first memory element for storing information about the first signal; a driver element coupled to the first memory element for outputting a second signal via an output terminal in accordance with the information about the first signal; and a calibration circuit coupled between the driver element and the input terminal for matching a potential difference between the driver element and the input terminal during a calibration phase prior to receiving the first signal.

11 Claims, 6 Drawing Sheets

U.S. PATENT DOCUMENTS

| | | | | |
|---|---|---|---|---|
| 2005/0285822 | A1* | 12/2005 | Reddy et al. | 345/76 |
| 2006/0001613 | A1* | 1/2006 | Routley et al. | 345/76 |
| 2006/0071886 | A1* | 4/2006 | Johnson et al. | 345/77 |
| 2006/0227085 | A1* | 10/2006 | Boldt et al. | 345/83 |
| 2006/0280360 | A1* | 12/2006 | Holub | 382/162 |
| 2007/0182673 | A1* | 8/2007 | Budzelaar | 345/76 |

FOREIGN PATENT DOCUMENTS

| | | | |
|---|---|---|---|
| GB | 2381643 | A | 5/2003 |
| WO | 9848403 | | 10/1998 |
| WO | 0217289 | A1 | 2/2002 |
| WO | 02071379 | A1 | 9/2002 |
| WO | 2002071379 | A2 | 9/2002 |

OTHER PUBLICATIONS

Written Opinion: PCT/IB05/050769, mailing date Jun. 3, 2005 and completion date May 25, 2005.

* cited by examiner

ELECTRICAL CIRCUIT ARRANGEMENT FOR A DISPLAY DEVICE

CROSS-REFERENCE TO RELATED APPLICATIONS

This application is a national stage application under 35 U.S.C. §371 of International Application No. PCT/IB2005/050769 filed on Mar. 2, 2005, and published in the English language as International Publication No. WO 2005/091269, which claims priority to European Application No. 04101031.5, filed on Mar. 12, 2004, incorporated herein by reference.

FIELD OF INVENTION

The invention relates to an electrical circuit arrangement for a display device comprising an input terminal for receiving a first signal, a first memory element, and a driver element for outputting a second signal in accordance with said first signal via an output terminal.

US 2001/0052606 discloses a display device comprising a matrix of pixels at crossings of row and column electrodes. The pixels each comprise a current mirror circuit to cope with transistor uniformity issues resulting from differences between drive transistors with respect to the charge carrier mobility and threshold voltage.

The currents in these types of display devices are very small, and the voltages required to drive pixels differ widely for pixels to be driven subsequently. This results in the disadvantage of long programming times for the display pixels, which are required to charge any parasitic capacitances with the very small currents. As these long programming times are not always available, the light emitted from the display pixels may not accurately reflect the current signal applied to the display pixel.

It is an object of the invention to provide an electrical circuit arrangement for a display device that has relatively short programming times.

This object is achieved by providing an electrical circuit arrangement for a display device, wherein said arrangement comprises an input terminal for receiving a first signal; a first memory element for storing information about the first signal; a driver element coupled to the first memory element for outputting a second signal via an output terminal in accordance with the information about the first signal; and a calibration circuit coupled between the driver element and the input terminal for matching a potential difference between the driver element and the input terminal during a calibration phase prior to receiving the first signal. By introducing this matching, there is no voltage change required at the input terminal during a subsequent programming phase if during this subsequent programming phase the second signal has to be programmed to the same value as during the previous programming phase. Usually, deviations between subsequent values of the second signal are small, so only small voltage changes are required of the input terminal. As these voltage changes are small, the required time to charge or discharge any parasitic capacitances, associated with the input terminal, is relatively short.

In a prior art arrangement, the potential of the input terminal prior to the programming phase may be quite different from the potential required during the programming, which results in a considerable time required to charge the parasitic capacitances during the programming phase. If in this case the charging is not completed before the end of the programming phase, the first memory element is not programmed correctly. In subsequent programming phases the same quite different potentials are present, which means that again the charging is not completed before the end of the programming phase. The electrical arrangement according to the invention allows recursive action, wherein the second signal approaches the first signal with even more accuracy if several identical first signals are received subsequently.

In an embodiment, the calibration circuit comprises a calibration switch for coupling the input terminal to a calibration voltage. By coupling the input terminal to the calibration voltage during the calibration phase, the voltage at the input terminal reaches in a relatively very short time the value of the calibration voltage. So, during the calibration phase the calibration circuit matches the difference between this calibration voltage and the potential of the driver element. The switch may be a common calibration switch for all calibration circuits coupled to the input terminal. The calibration switch may be controlled by a display controller.

In an embodiment the calibration circuit further comprises a calibration transistor coupled with its main terminals between the input terminal and the driver element, and a second memory element coupled to a gate of the calibration transistor. In this embodiment the calibration transistor carries during the calibration phase through its main terminals a current corresponding to the first signal of the previous programming phase. The second memory element is set during this calibration phase to such a value, that the gate of the transistor receives a voltage, which results in the desired current, so corresponding to the previous first signal, through the main terminals while the voltage difference between its main terminals matches the voltage difference between the input terminal and the driver element. As a result, if after the calibration phase during a subsequent programming phase the first signal is applied in the form of a current to the calibration circuit, no potential changes of the input terminal are required, if the first signal is the same as the previous first signal.

The calibration circuit may further comprise a switch coupled between one of the main terminals and the gate of the calibration transistor. This switch may be closed during the calibration phase to couple the potential of the driver element to the second memory element.

A further switch may be coupled between the driver element and the output terminal in order to block an output current, forming the second signal as provided by the driver element, from flowing to the output terminal during the calibration and programming phase.

Another switch may be coupled between the driver element and the calibration circuit. This switch may be closed during the calibration and the programming phase to couple the output current to the calibration transistor.

In a preferred embodiment of the invention the first memory element is arranged in a current mirror circuit. Current mirror circuits facilitate in replication of an input signal to an identical output signal.

The driver element may be a drive transistor having a gate connected to said first memory element, and a main terminal coupled to the calibration circuit, the gate further being coupled via a switch to the main terminal of the drive transistor. This is a simple, cost effective solution.

The first memory element may comprise a capacitor.

The invention further relates to a column driver comprising an electrical circuit arrangement as described above. This element of a display device typically receives a first signal that is to be quickly and accurately converted to a second signal.

The invention further relates to a display device comprising a plurality of display pixels comprising an electrical circuit arrangement as described above.

Another aspect of the invention provides a product comprising the display device according to the invention and signal processing circuitry. The product may be a handheld device such as a mobile phone, a Personal Digital Assistant (PDA) or a portable computer as well as a device such as a monitor for a Personal Computer, a television set, or a display on e.g. a dashboard of a car.

The invention finally relates to a method for addressing a display pixel. Further dependent claims define advantageous embodiments.

BRIEF DESCRIPTION OF THE DRAWINGS

The invention will be further illustrated with reference to the attached drawings, which show a preferred embodiment according to the invention. It will be understood that the invention is not in any way restricted to this specific and preferred embodiment.

In the drawings.

DETAILED DESCRIPTION OF THE EMBODIMENTS OF THE INVENTION

Figure 1:
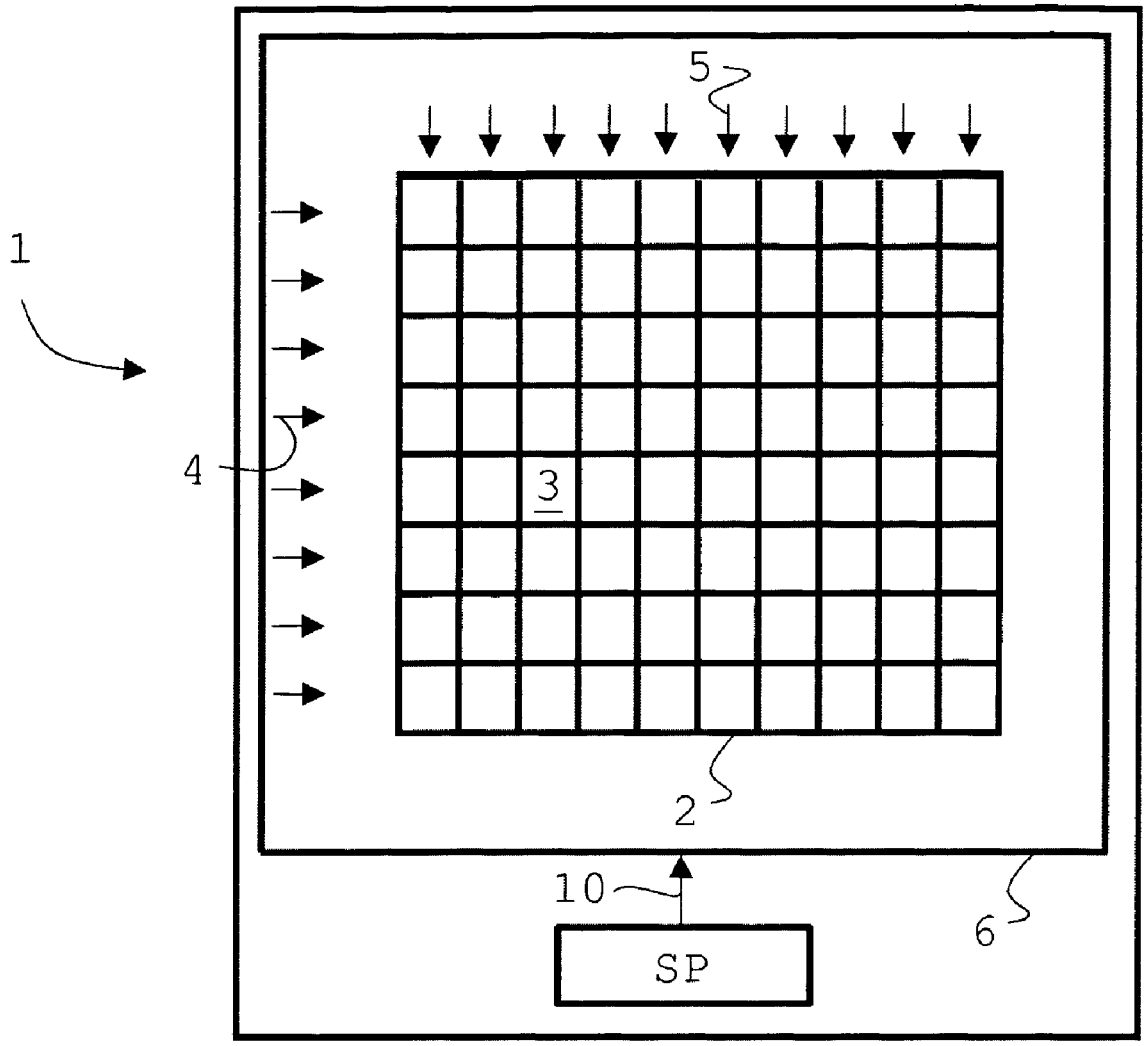
FIG. 1 shows a product comprising an active matrix display device.

FIG. 1 shows a product 1 comprising an active matrix display device 6 and signal processing circuitry SP. The display device 6 comprises an active matrix display panel 2 having a plurality of display pixels 3 arranged in a matrix of rows 4 and columns 5. The display panel 2 is an active matrix display comprising display pixels 3 containing polymer light emitting diodes (PLEDs) or small molecule light emitting diodes (SMOLEDs). The display panel 2 may be a high resolution display panel as the available programming times in such display panels are very small.

The product 1 may be a television receiver, in which case the signal processing circuitry SP may include circuitry for receiving a television signal and converting the television signal into a format for driving a data input 10 of the display device 6. Alternatively, the product 1 may be a handheld device such as a mobile phone or PDA, a portable computer or a monitor for a personal computer or any other product with a display device. In these cases the signal processing circuitry SP may include data processing circuitry and circuitry for processing of images to be displayed into a format suitable for driving the data input 10.

Figure 2:
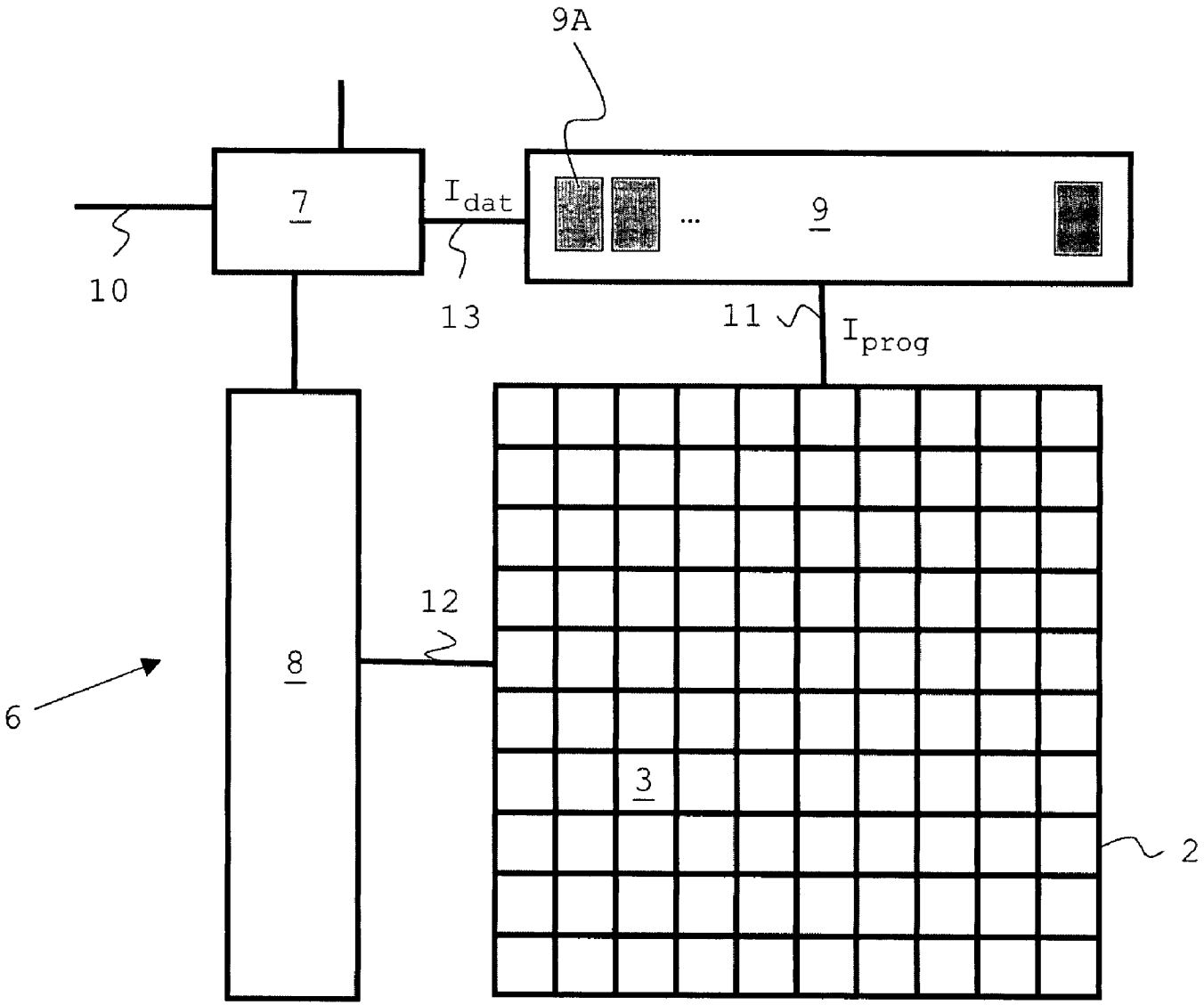
FIG. 2 shows a schematical illustration of an active matrix display device shown in FIG. 1.

FIG. 2 shows a schematical illustration of an active matrix display device 6, comprising e.g. a PLED display panel 2 of product 1 as shown in FIG. 1. The display device 6 comprises a display controller 7, including a row selection circuit 8 and a column driver 9 including driver parts 9A for driving the respective columns 5 (see FIG. 1) of display pixels 3. A data signal, comprising information or data such as for (video) images to be presented on the display panel 2, is received via a data input 10 by the display controller 7. The data may be written as driver programming currents $I_{dat}$ via line 13, the column driver 9 and data lines 11 to the appropriate display pixels 3 for each column 5. The selection of the rows 4 (see FIG. 1) of display pixels 3 is performed by the row selection circuit 8 via selection lines 12, controlled by the display controller 7. Synchronization between selection of the rows 4 of display pixels 3 and writing of the data to the display pixels 3 is performed by the display controller 7.

Figure 3:
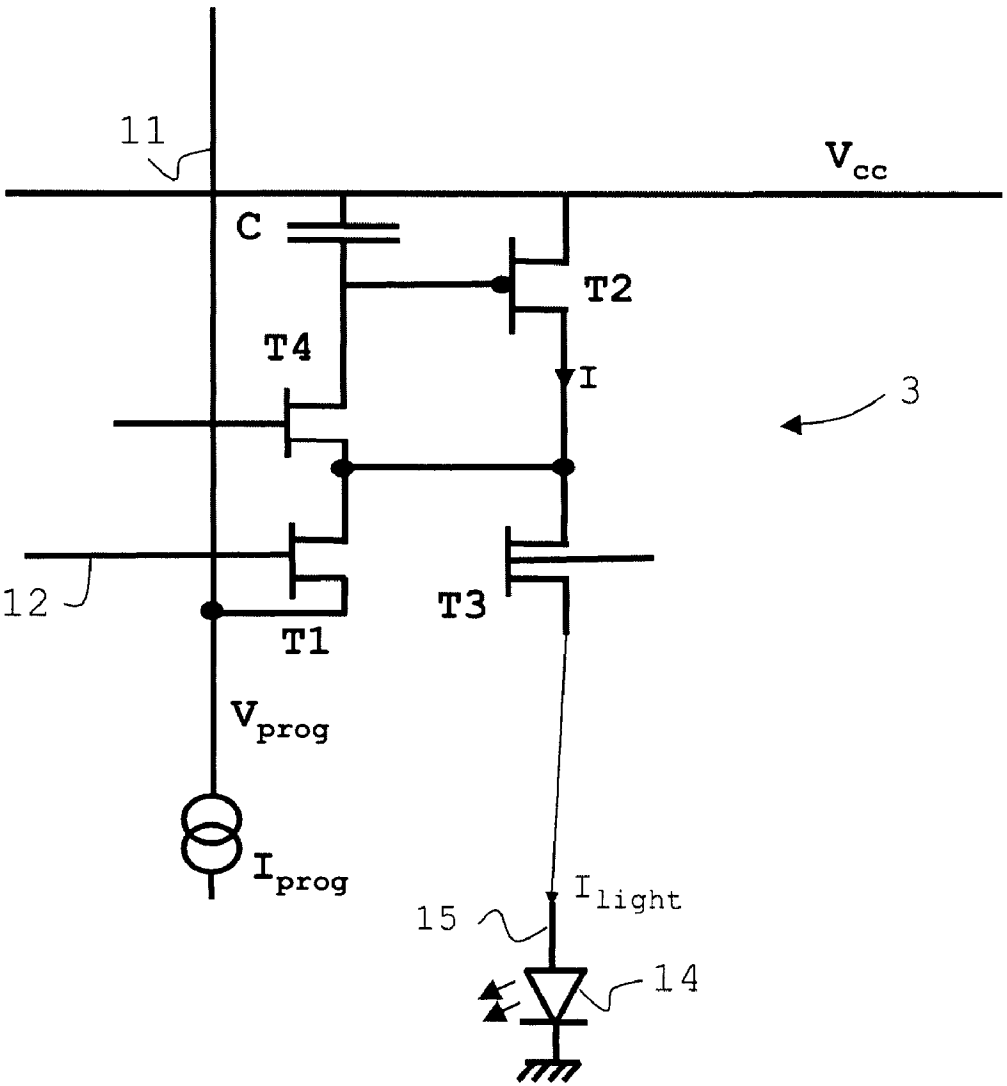
FIG. 3 shows detailed illustrations for a display pixel and a driver part of a column driver for an active matrix display as shown in FIG. 2.

FIG. 3 shows an electrical circuit arrangement for a current programmable display pixel 3 wherein a first signal is applied as a current $I_{prog}$ via the column electrode 11.

A driving transistor T2 is used in both programming the display pixel 3 and in driving an emissive element 14, such as a PLED element, via terminal 15. The application of the programming current over the column electrode 11 is indicated by a current source $I_{prog}$, representing the driver part 9A. During the programming period a transistor T4 connects a capacitor C with a current carrying electrode of the driving transistor T2 while the emissive element 14 is isolated from the driving transistor T2 by a transistor T3. During this programming phase the data input programming current is forced through T2 while the capacitor C is charged or discharged depending on the previously programmed value to reach the associated gate-source voltage VGS for T2. Now, by opening T1 and T4 and by closing T3, the drain current of the driving transistor T2 is fed as a second signal to the emissive element 14. The memory function of the capacitor C assures that the current is a copy of the programming current signal received over line 11.

The current I through the driving transistor T2 is equal to $I_{prog}$ which is proportional to $\mu(V-Vt)^2$, wherein $\mu$ is the mobility of the charge carriers, Vt the threshold voltage of the driving transistor T2 and V the gate-source voltage of the driving transistor T2. It is assumed here that the current I from the driving transistor T2 is indeed identical to the programming current $I_{prog}$, which is a reasonable approximation for a display pixel 3 with a current mirror circuit. The programming voltage $V_{prog}$ representing the voltage that results from the application of the programming current $I_{prog}$ therefore yields:

$$V_{prog}=V_{cc}-Vt-\sqrt{(I_{prog}/\mu)}$$

wherein $V_{cc}$ is the voltage supplied to the power line. The current mirror circuit of the display pixel 3 shown in FIG. 3 has the advantageous feature that at low frequencies, despite differences in mobility $\mu$ and threshold voltages Vt of the driving transistors between the various display pixels 3, the current $I_{light}$ through the emissive element, being equal to the current I through the driving transistor T2, is an almost exact copy of the received programming current. This current $I_{light}$ will hereinafter also be called the second signal. Each driver part 9A may apply the same circuit arrangement as described above for the display pixels. In this case (see FIG. 2) the column driver 9 receives data in the form of the driver programming currents $I_{dat}$ (corresponding to the first signal) via line 13. Each of the driver parts 9A may be programmed sequentially by its corresponding part of the driver programming currents $I_{dat}$. After the sequential programming of the driver parts 9A, each of the driver parts 9A may simultaneously provide its programming current $I_{prog}$ to the data line 11 coupled to it. So, in case the electrical circuit arrangement is applied to a driver part 9A, the programming current $I_{prog}$, being the resulting output of the arrangement, corresponds to the second signal as mentioned in the description of the current programmable display pixel 3.

Figure 4:
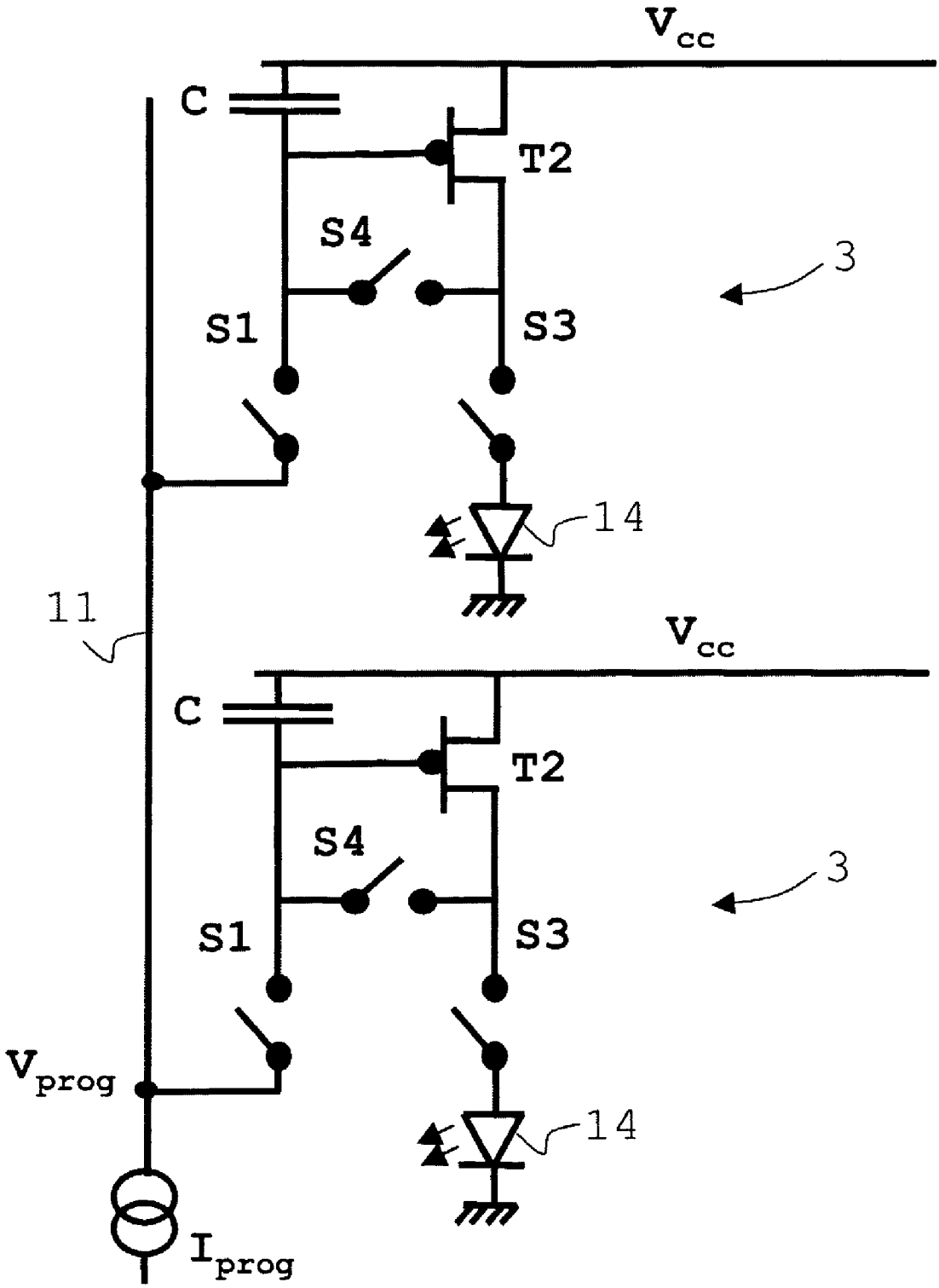
FIG. 4 shows two display pixels as shown in FIG. 3 along a column electrode of the display shown in FIG. 2.

FIG. 4 shows two display pixels 3 as shown in FIG. 3 of all the display pixels 3 along the column electrode 11 of the display panel 2. For reasons of clarity the transistors T1, T3 and T4 have been drawn as switches S1, S3 and S4. The mobilities it and threshold voltages Vt of the driving transistors T2 determine the voltage $V_{prog}$ on the column electrode 11 as the display pixel circuits stabilize for a given programming current $I_{prog}$. As the transistors T2 are not identical with respect to the mobility and threshold voltage, the voltage $V_{prog}$ may differ significantly. When the lower display pixel 3 is programmed with a first programming current $I_{prog}$, the corresponding switch S1 is closed and the voltage $V_{prog}$ at the column electrode 11 will stabilize at a certain value depending on the first programming current and the characteristics of T2 of this display pixel 3. If subsequently the upper display pixel 3 is programmed, S1 of the lower display pixel 3 opens while S1 of the upper display pixel 3 is closed. Even when the programming current is the same as for the lower display pixel 3, the voltage $V_{prog}$ is likely to stabilize at a different value compared to the voltage for the lower display pixel 3 because the characteristics of the driving transistor T2 of the upper display pixel 3 are presumably different from those of the driving transistor T2 of the lower display pixel 3.

The programming currents $I_{prog}$ are typically low, i.e. in the order of nanoamperes in the dark region to microamperes at full brightness of the emissive element 14. The line capacitance of the column electrode 11 may be in the order of 100 pF. Thus for a difference in the programming voltage $V_{prog}$ of 1 Volt between the upper and lower display pixel 3, a programming current of 10 nanoamperes results in a period of 10 milliseconds to bring the column electrode 11 to the required voltage $V_{prog}$. Such long stabilization times limit operation of the display panel 2 at high frequencies, requiring relatively short programming times. For a high resolution display panel 2 the capacitance of the column electrode 11 increases, yielding worse performance. Further the trend to use higher resolutions and the use of highly efficient organic LED material results in a decrease of the programming currents for each display pixel 3.

Figure 5:
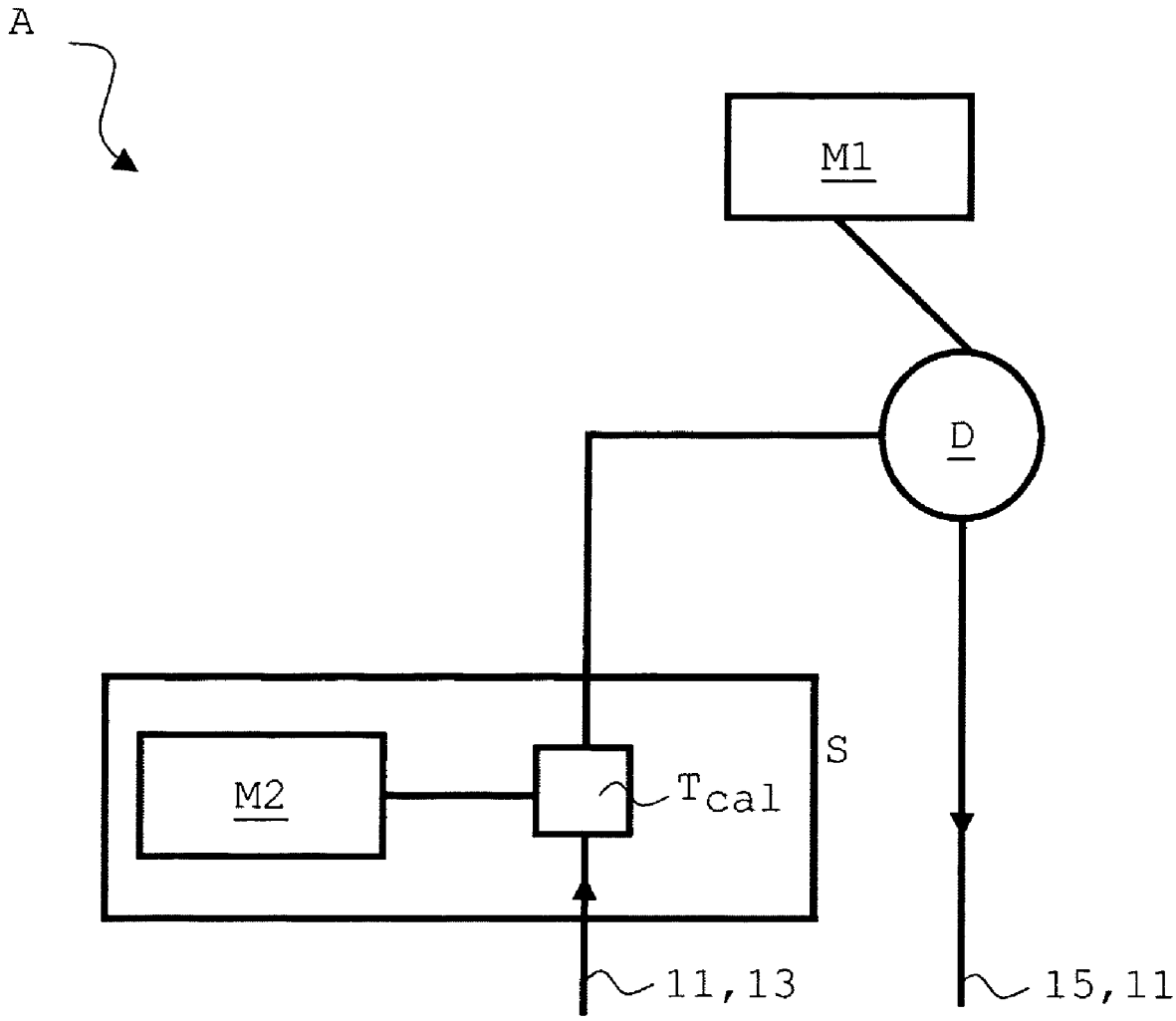
FIG. 5 shows an active matrix display device incorporating a display pixel according to an embodiment of the invention.

FIG. 5 is a schematic illustration of the basic idea of the invention. An electrical circuit arrangement A for a display pixel 3 or a driver part 9A as used in a display device 6 as shown in FIG. 2 comprises an input terminal 11, 13 respectively, for receiving as first signal the current $I_{prog}$ or $I_{dat}$ and an output terminal 15 or 11, respectively, for outputting as the second signal the current $I_{light}$ or $I_{prog}$ for a display pixel 3 or a driver part 9A, respectively. The arrangement A further contains a first memory element M1 coupled to a driver D for outputting the second signal $I_{light}$ or $I_{prog}$ in accordance with the first signal $I_{prog}$ or $I_{dat}$, and a second memory element M2 connected to a calibration circuit S for matching a potential difference between the driver D and the input terminal 11, 13 by storing data in the second memory element M2 related to said first signal $I_{prog}$ or $I_{dat}$.

In operation the first signal $I_{prog}$ or $I_{dat}$ is received at the input terminal 11, 13 and stored in the first memory element M1 during a programming phase. A second signal $I_{light}$ or $I_{prog}$ is generated from the driver element D in accordance with the first signal $I_{prog}$ or $I_{dat}$ during an output phase. Next, the data relating to the first signal $I_{prog}$ or $I_{dat}$ are stored in the second memory element M2 during a calibration phase. The data relating to the first signal may be transferred via the calibration circuit to the second memory M2 or may be transferred via a direct coupling of the first memory M1 and the second memory M2 (not shown). The data stored in the second memory M2 are used to preset the calibration circuit. This preset involves the setting of a voltage across the calibration circuit which matches the difference between the potential of the input terminal 11, 13 and the driver D. This setting is done during the calibration phase to such a value, that it carries the current corresponding to the previously received first signal. As a result, when the further first signal does not differ from the previous one, there is no change of the potential of the input terminal 11, 13, required and as a consequence, there is for example, no delay in the programming phase caused by the charging of the line capacitance by the programming current $I_{prog}$.

So, if subsequently a further first signal is received at the input terminal 11,13 a potential of said input terminal 11,13 only changes if the further first signal differs from the previously received first signal or the data stored in M2 are not yet in accordance with the data relating to the first signal although the further first signal is identical to the original or previous first signal.

Optionally the calibration phase may be skipped if the further first signal does not differ from the previously received first signal. When using this method, only a difference in potential of the input terminal 11,13 that may arise from two differing subsequent first signal $I_{prog}$ or $I_{dat}$ needs to be effected. Such a change of the potential can be effected much quicker as a result of which the second signal, i.e. $I_{light}$ or $I_{prog}$ respectively, can be a more accurate copy of the first signal $I_{prog}$ or $I_{dat}$. Further, the method allows recursive action, wherein the second signal $I_{light}$ or $I_{prog}$ approaches the first signal $I_{prog}$ or $I_{dat}$ with even more accuracy if several identical first signals are received at the input terminal 11,13. Indeed for subsequent frames presented on a display panel 2, the information to be displayed by a display pixel 3 of the display panel 2 is often substantially the same.

Figures 6A, 6B, 6C:
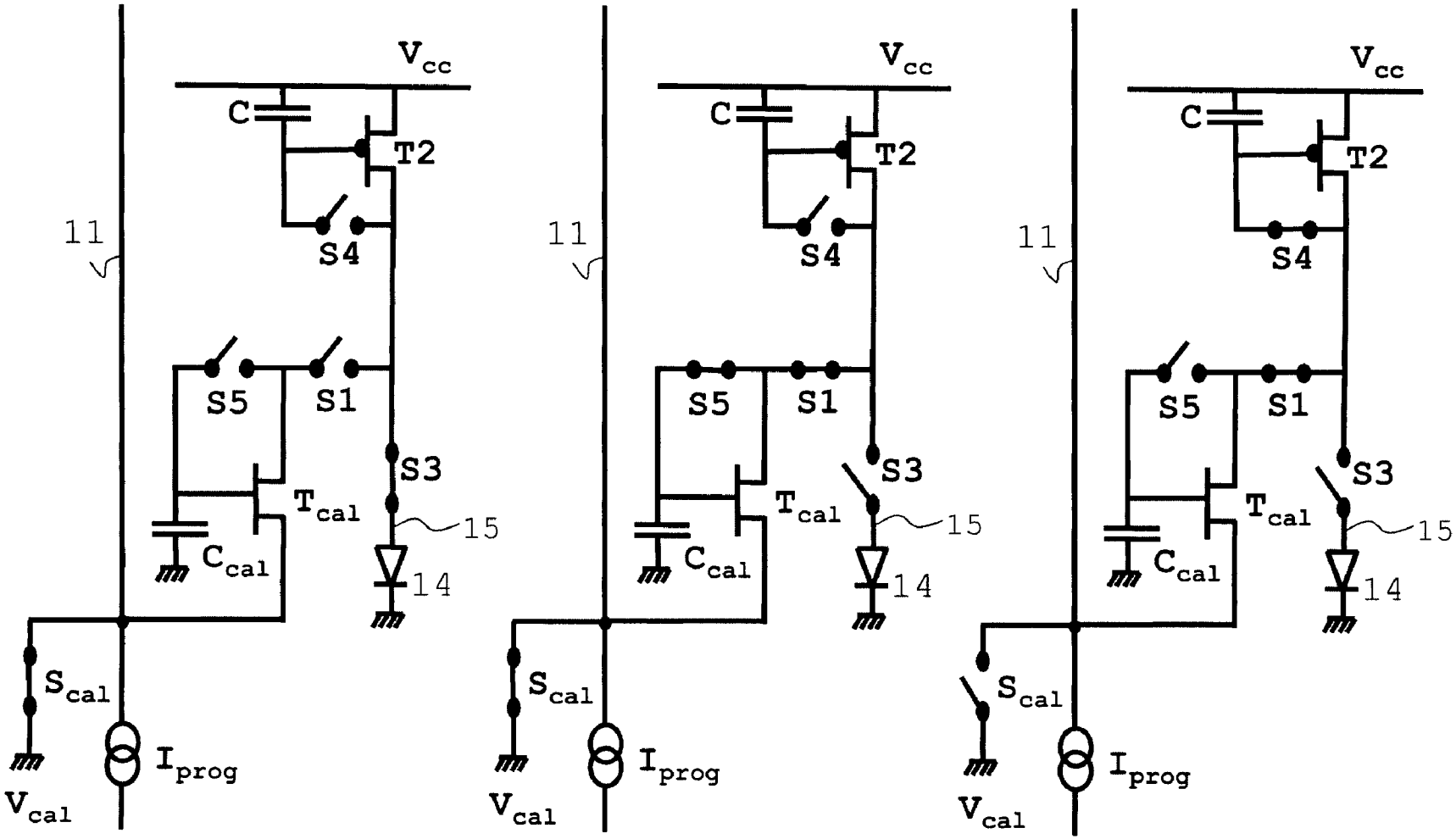
FIGS. 6A-6C show various stages in the operation of the active matrix display device according to an embodiment of the invention.

FIGS. 6A-6C show an application of the basic arrangement A displayed in FIG. 5 for a display pixel 3. It should however be appreciated that the invention is by no means limited to this specific application.

In FIG. 6A the display pixel 3 is shown in the output phase. The voltage over the capacitor C may cause T2 to drive the current emissive element 14 via the second terminal 15 with a second signal $I_{light}$ as a result of a previously received first signal $I_{prog}$ of which data are stored at the capacitor C. It should be appreciated that the invention does not require that light is emitted from the emissive element 14. T2 corresponds to the driver element D and the capacitor C corresponds to the first memory element M1 of FIG. 5.

In FIG. 6B the calibration phase is shown. The data relating to the previous first signal $I_{prog}$ are transferred to the capacitor $C_{cal}$ by closing switches S1 and S5 prior to reception of a first signal $I_{prog}$ at the column electrode 11. The capacitor $C_{cal}$ corresponds to the second memory element M2 in FIG. 5. This calibration phase may be triggered by the display controller 7 actuating switches S1 and S5. S3 is open. Switch S4 is open such that the display pixel 3 is not programmed by charging or discharging the capacitor C. In this calibration phase the switch $S_{cal}$ is closed applying a calibration voltage $V_{cal}$ of e.g. 0 Volts to the column electrode 11. At the same time the current of T2 is forced through a calibration transistor $T_{cal}$ and a calibration capacitor $C_{cal}$ is programmed to continue this current through $T_{cal}$, while the column line 11 is kept at the potential of the calibration voltage of e.g. 0 Volts. The gate voltage of the calibration transistor $T_{cal}$ is connected to the capacitor $C_{cal}$ such that while the calibration voltage is present on the column electrode 11, a current substantially equal to the previously received first signal $I_{prog}$ of FIG. 6A, is flowing through $T_{cal}$ as during this calibration phase switch S3 is open, and the driver current is forced to flow through $T_{cal}$ and not in the emissive element. The transistor $T_{cal}$ with the switches $S_5$ and $S_{cal}$ correspond to the calibration circuit in FIG. 5.

FIG. 6C illustrates the programming phase wherein the display pixel 3 is programmed by charging the capacitor C to the adequate voltage. Accordingly, S5 is opened, switch S4 is closed and switch S3 remains opened. Further the switch $S_{cal}$ is opened to allow the first programming current signal into the display pixel 3. The capacitor $C_{cal}$ ensures maintenance of the input state on the column electrode 11 after opening of the switch $S_{cal}$. As S5 is opened the gate voltage of the calibration transistor $T_{cal}$ will remain constant at the value previously calibrated. As a result of the current setting of $T_{cal}$, the drain current of $T_{cal}$ equals the programming current of the previously applied first signal. The actual programming current will now flow through $T_{cal}$, S1 and T2 such that the voltage over the capacitor C increases or decreases to a value where the current through the driving transistor T2 is equal to the programming current $I_{prog}$.

If the display pixel 3 should not emit light for a particular percentage of the frame time when it is not addressed, i.e. a reduced duty cycle applies, the switch S3 should be open for this percentage of the frame time.

The calibration phase described above may be executed row-wise for each column 5. However, it is advantageous to execute the calibration phase for more than one row 4 of display pixels 3 at the time or even for the whole display panel 2 at once. The latter option requires the charge on $C_{cal}$ to be sufficiently stable, i.e. no or negligible leakage, over the relevant period of time, i.e. the time during which the calibration voltage $V_{cal}$ should be maintained for the display pixel 3. The initiation of the calibration phase for one or more rows 4 can be controlled by the display controller 7.

A result of the calibration phase displayed in FIG. 6B is that the display pixels 3 can be quickly and accurately current programmed as a result of the calibration with the previously applied current signal. Further, if substantially the same current signals are received as subsequent first signals for a particular display pixel 3 at the input terminal 11, the remaining error in the current output to the emissive element 14 will reduce as a result of the recursive action provided by the presence of the first and second memory elements C and $C_{cal}$. Also for changing pictures, the light output required for a considerable amount of display pixels 3 remains the same.

A disadvantage of the active matrix display device 6 according to the invention is the increase in the area accommodated by circuitry for each display pixel 3 which is detrimental for the aperture of the display pixel. However, for top emission display panels 2, wherein the light of the emissive element 14 is emitted away from the display pixel circuitry, this is not an issue.

The invention can be applied in active current-addressed matrix displays as described above and allows poor initial matching of the driver transistors T2 between the display pixels 3. Also field emission display drivers can advantageously use the invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. Electrical circuit arrangement for a display device, the electrical circuit arrangement comprising
   - an input terminal for receiving a first signal;
   - a first memory element for storing information related to the first signal;
   - a second memory element;
   - a driver element coupled to the first memory element for outputting a second signal via an output terminal based on the information about the first signal; and
   - a calibration circuit coupled between the driver element and the input terminal for matching a potential difference between the driver element and the input terminal during a calibration phase prior to receiving the first signal, the matching being such that there is no voltage change required at the input terminal during a subsequent programming phase if during a current programming phase the second signal is programmed to the same value as during a previous programming phase,
     - wherein the calibration circuit comprises a calibration transistor coupled with a main terminal between the input terminal and the driver element, and
     - wherein the second memory element is coupled to a gate of the calibration transistor.

2. Electrical circuit arrangement according to claim 1, the calibration circuit comprising a calibration switch for coupling the input terminal to a calibration voltage.

3. Electrical circuit arrangement according to claim 1, wherein the second memory element is configured for storing data related to the first signal obtained from the first memory during the calibration phase.

4. Electrical circuit arrangement according to claim 1, the calibration circuit further comprising a first switch coupled between one of the main terminals and the gate of the calibration transistor.

5. Electrical circuit arrangement according to claim 1, comprising a second switch coupled between the driver element and the output terminal.

6. Electrical circuit arrangement according to claim 1, comprising a third switch coupled between the driver element and the calibration circuit.

7. Electrical circuit arrangement according to claim 1, wherein said driver element (D) is a drive transistor having a gate connected to said first memory element, and a main terminal coupled to the calibration circuit, said gate further being coupled via a fourth switch to the main terminal of the drive transistor.

8. Display device comprising:
   - a plurality of display pixels, each of the display pixels comprising an electrical circuit arrangement (A) according to claim 1, and an emissive element coupled to said output terminal and adapted to emit light on reception of said second signal; and
   - a display controller adapted to control the calibration phase of the plurality of display pixels.

9. Display device according to claim 8, comprising for each input terminal one common calibration switch for coupling the input terminal to a calibration voltage.

10. Method for addressing a display pixel of a display device comprising an input terminal, a first memory element, a second memory element, a driver transistor coupled to an output terminal, and a calibration circuit comprising a calibration transistor coupled with a main terminal between the driver transistor and the input terminal, wherein the second memory element is coupled to the calibration transistor, the method comprising the steps of:

storing information about a first signal in said first memory element;

generating a second signal from said driver transistor in accordance with the information about the first signal; and enabling the calibration circuit to match a potential difference between the driver transistor and the input terminal during a calibration phase prior to receiving the first signal, the matching being such that there is no voltage change required at the input terminal during a subsequent programming phase if during this programming phase the second signal has to be programmed to the same value as during the previous programming phase.

11. An electrical circuit arrangement for a display device, comprising:

an input terminal for receiving a first signal;

a first memory element for storing information about the first signal;

a driver transistor having a main terminal and a gate connected to the first memory element for outputting a second signal via an output terminal based on the information about the first signal, wherein the gate is further coupled via a switch to the main terminal; and a calibration circuit coupled between the main terminal and the input terminal for matching a potential difference between the driver transistor and the input terminal during a calibration phase prior to receiving the first signal, the matching being such that there is no voltage change required at the input terminal during a subsequent programming phase if during a current programming phase the second signal is programmed to the same value as during a previous programming phase.

* * * * *